US005480608A

United States Patent [19]

Tsuda et al.

[11] Patent Number: 5,480,608

[45] Date of Patent: Jan. 2, 1996

[54] FERRITIC STAINLESS STEEL HAVING AN EXCELLENT OXIDATION RESISTANCE

[75] Inventors: Masaomi Tsuda, Chuo; Yoshito Fujiwara; Yuji Ikegami, both of Kawasaki; Masao Sato, Tokyo; Hiroyuki Fujii, Kawasaki, all of Japan

[73] Assignee: Nippon Yakin Kogyo Co., Ltd., Tokyo, Japan

[21] Appl. No.: 338,447

[22] PCT Filed: Mar. 19, 1993

[86] PCT No.: PCT/JP93/00326

§ 371 Date: Dec. 13, 1994

§ 102(e) Date: Dec. 13, 1994

[87] PCT Pub. No.: WO94/21836

PCT Pub. Date: Sep. 29, 1994

[51] Int. Cl.[6] ..... C22C 38/06; C22C 38/28

[52] U.S. Cl. ..... 420/40; 420/63; 420/62

[58] Field of Search ..... 420/40, 62, 63; 148/325

[56] References Cited

U.S. PATENT DOCUMENTS

| | | | |
|---|---|---|---|
| 3,852,063 | 12/1974 | Nimi et al. . | |
| 4,859,649 | 8/1989 | Böhnke et al. . | |
| 4,870,046 | 9/1989 | Yamanaka et al. . | |
| 4,904,540 | 2/1990 | Ishii et al. | 420/40 |

FOREIGN PATENT DOCUMENTS

| | | |
|---|---|---|
| 0387670 | 9/1990 | European Pat. Off. . |
| 0480461 | 4/1992 | European Pat. Off. . |
| 63-45351 | 2/1988 | Japan . |
| 63-266044 | 11/1988 | Japan . |
| 63-317651 | 12/1988 | Japan . |
| 1-99647 | 4/1989 | Japan . |
| 2-58340 | 12/1990 | Japan . |
| 3170642 | 7/1991 | Japan . |

OTHER PUBLICATIONS

English Language Abstract of JP 1–99647.
English Language Abstract of JP 63–45351.
English Language Abstract of JP 3–170642.

*Primary Examiner*—Deborah Yee
*Attorney, Agent, or Firm*—Sandler, Greenblum & Bernstein

[57] ABSTRACT

A ferritic stainless steel having excellent oxidation resistance, toughness and hot workability contains 0.001–0.20% of at least one of Ca, Mg and Ba as an amount of [Ca]+[Mg]+⅓[Ba], and La: 0.06–0.5% and Ce: 0.002–0.050% in addition to C, Si, Mn, Ni, Cr, Al, Ti and N as a main component provided that these components satisfy relations of the following equations (1)–(3):

$$[S] \leqq [Ca]+[Mg]+\tfrac{1}{3}[Ba] \quad (1)$$

$$[La]/[Ce] \geqq 5 \quad (2)$$

$$Ti \geqq \tfrac{48}{12}[C]+\tfrac{48}{14}[N] \quad (3)$$

4 Claims, 4 Drawing Sheets

FERRITIC STAINLESS STEEL HAVING AN EXCELLENT OXIDATION RESISTANCE

TECHNICAL FIELD

This invention relates to ferritic stainless steels having an excellent oxidation resistance, and more particularly to Fe-Cr-Al series ferritic stainless steel usable as a material in combustion cylinder for stove, exhaust gas purifying device for automobile, electric heating body and the like and having improved oxidation resistance, toughness and hot workability.

BACKGROUND ART

In general, it is known that the ferritic stainless steel is a material suitable for applications requiring the oxidation resistance such as the exhaust gas purifying device for automobile, combustion cylinder for the stove and the like. In the recent exhaust gas purifying device for automobile, however, the thickness of the plate used in the device is thinned to reduce the resistance to the exhaust gas flowing and mitigate the loading on the engine. And also, the thickness of the combustion cylinder in the stove is thinned in order to enhance the combustion efficiency, whereby the temperature is increased and the cost is reduced. In any case, the thickness reduction is attempted by these means, so that the service life of the stainless steel is considerably degraded.

For this end, ferritic stainless steels having a greater amount of Al have mainly been proposed, but as the amount of Al in the stainless steel increases, the brittleness of hot rolled steel sheet is promoted to increase the degree of cracking or breaking of the sheet passing in the sheet production and further it is impossible to conduct the production in the usual producing apparatus.

As a technique for overcoming the above problem of the high Al-content ferritic stainless steel, there is proposed a method as disclosed in JP-B-2-58340. In this technique, rare earth elements of Ce, La, Pt, Nd and the like are added in a total amount of up to 0.060 wt %, but if it is intended to manufacture products having particularly a thin thickness, there is caused another problem that the working can not be carried out at a usual hot working temperature.

There is proposed another method as described in JP-B-4-8502 (JP-A-63-45351). This method is a technique developed for overcoming the problem included in the method of JP-B-2-58340. The feature of this technique is rolling work having no cracking is made possible to more improve oxidation resistance by adding lanthanoides other than Ce being a serious factor. However, such a technique is required to separate and remove Ce from the rare earth elements (hereinafter abbreviated as "REM"), so that the cost increases and also there is caused a problem that the oxidation resistance of joint portion in a honeycomb structural body is insufficient.

In order to overcome the above problems of the conventional techniques (JP-B-2-58340 and JP-B-4-8502), there is further proposed a method described in JP-A-3- 170642. This method is concerned with foils of ferritic stainless steel having not only excellent oxidation resistance in form of foil even in a high-speed stream of a high-temperature combusted exhaust gas but also developing an effect of maintaining the durability as a carrier for a catalyst and cheap productivity. This technique particularly strengthens the bonding between P and Ce to improve the hot workability by adjusting the amount of P added in accordance with the amount of REM. However, it is frequently caused that the P-compound does not effectively act to the oxidation resistance, and particularly the oxidation resistance in joint portion through soldering, welding or the like is considerably degraded.

In the above conventional techniques, there is a further problem to be solved that ferritic stainless steel having excellent toughness and hot workability is not obtained together with the more improvement of the oxidation resistance.

It is, therefore, an object of the invention to provide ferritic stainless steels capable of overcoming the aforementioned problems.

DISCLOSURE OF INVENTION

In order to realize the above object, the invention proposes a ferritic stainless steel having an excellent oxidation resistance, comprising C: not more than 0.030 wt %, Si: 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06–0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and the reminder being Fe and inevitable impurities (first invention).

Further, the invention proposes a ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06– 0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing at least one of V: 0.05–2.0 wt % and W: 0.05–2.0 wt %, and the reminder being Fe and inevitable impurities (second invention).

And also, the invention proposes a ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06– 0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing Mo: 0.01–1.0 wt %, and the reminder being Fe and inevitable impurities (third invention).

Moreover, the invention proposes a ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06– 0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing at least one of V: 0.05–2.0 wt % and W: 0.05–2.0 wt % and Mo: 0.01–1.0 wt %, and the reminder being Fe and inevitable impurities (fourth invention).

MODE FOR CARRYING OUT THE INVENTION

The invention lies in a point of developing ferritic stainless steels having improved toughness and hot workability in addition to oxidation resistance.

In order to improve the toughness and hot workability in addition to the oxidation resistance as mentioned above, it is effective to conduct an alloying design as mentioned below. That is, (1) In order to improve the oxidation resistance of joint portion or the like, it is required that the amounts of La and Ce are made larger than the conventionally known ones and the La/Ce ratio is set to a favorable value.

(2) It is required that amounts of Ca, Mg and Ba controlling the action of S which has a large influence upon the oxidation resistance are set to favorable values, respectively.

(3) In order to improve the toughness without degrading the oxidation resistance, it is required that each amount of Ti, C and N is set to a favorable value.

(4) In order to improve the hot workability, it is required that amounts of S, P and O are reduced and particularly the amount of O is severely restricted up to 10 ppm as compared with the conventional one.

As a result, the invention is based on the above ideas and develops ferritic stainless steels having desired properties by controlling the composition of the steel components.

The reason why the composition of the steel according to the invention is restricted as mentioned above is described with respect to a relation among main components.

(1) La: 0.06–0.5 wt %, Ce: 0.002–0.05 wt %, [La]/[Ce]≧5

La and Ce are effective for the improvement of the oxidation resistance. Particularly, when the amount of La is less than 0.06 wt %, the effect is insufficient, while when it exceeds 0.50 wt %, the cleanness is poor and the workability is degraded.

Furthermore, Ce is effective to the oxidation resistance in view of the control of scale peeling. In order to obtain such an effect, it is required to be added in an amount of at least 0.002 wt %. However, when a great amount of Ce is added, the addition effect of Ce rather lowers, so that the upper limit is 0.050 wt %.

When La and Ce are heated to not lower than 1200° C. in the soldering, they diffuse into a soldered portion to reduce an effective amount, so that it is necessary to add a greater amount of them. Further, a restricted portion such as joint portion or the like causes stress concentration in heating-cooling cycle to create cracks in an oxide film, which tends to degrade the oxidation resistance. In this case, when La/Ce≧5, the restoring function of the film is enhanced to improve the oxidation resistance.

Figure 2:
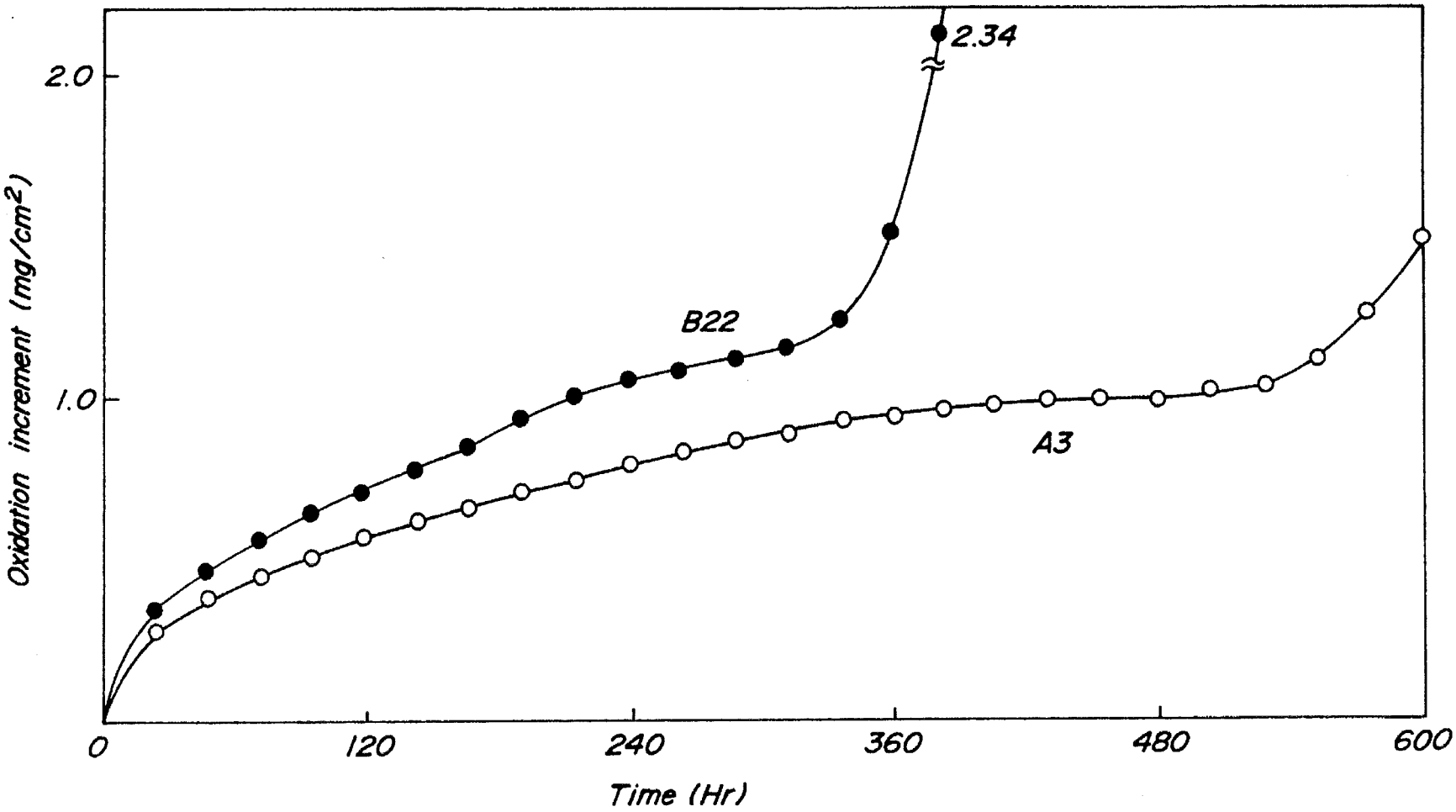
FIG. 2 is a graph showing an influence of La/Ce ratio upon oxidation increment.
Figure 3:
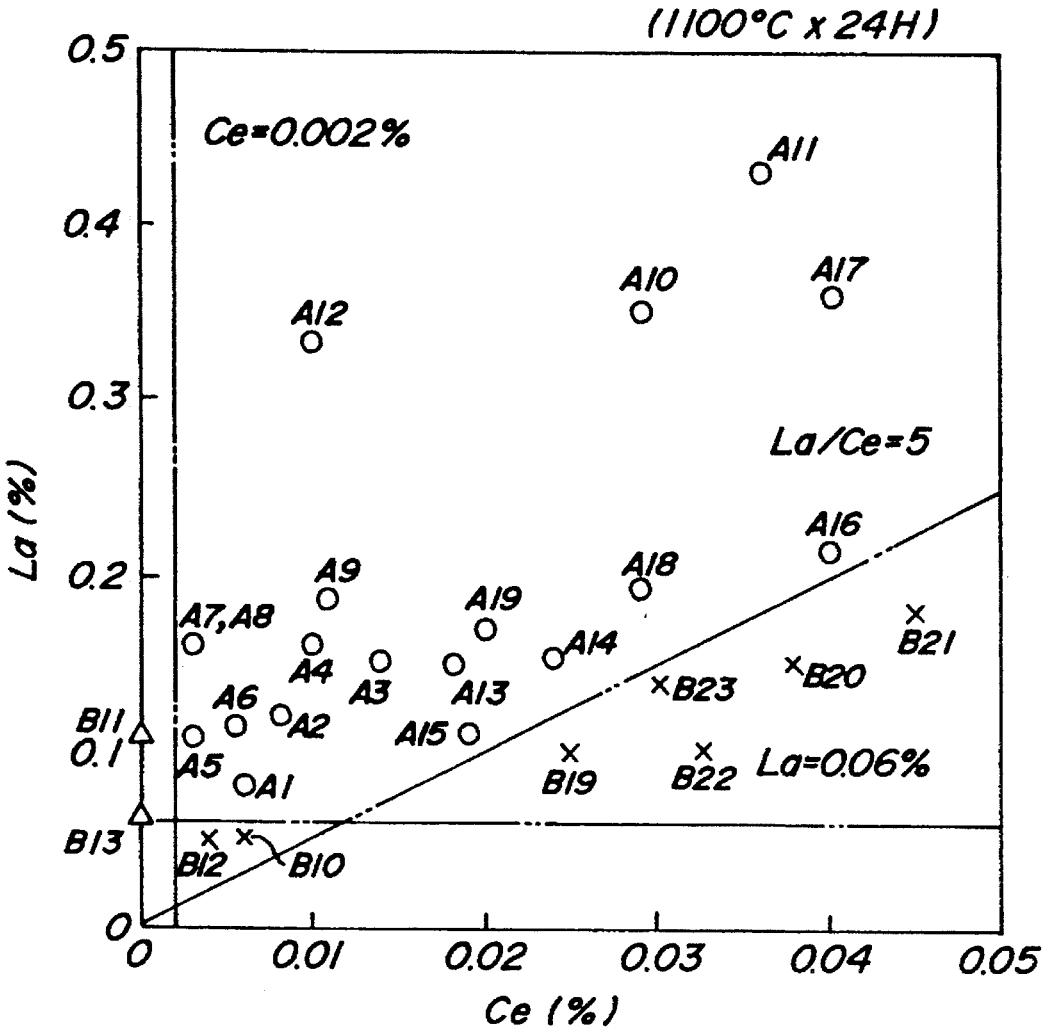
FIG. 3 is a graph showing an influence of relation between Ce and La upon oxidation resistance (1100° C.×24 Hr).

As shown by two curves of oxidation increment in FIG. 2, when La/Ce≧5, the diffusion of oxygen in $Al_2O_3$ is controlled, from which it is confirmed to shift the curve of oxidation increment toward a lower curve. When the repetitive test of oxidation at 1100° C. is carried out under such an action, the oxidation resistance is improved as shown in FIG. 3.

Figure 4:
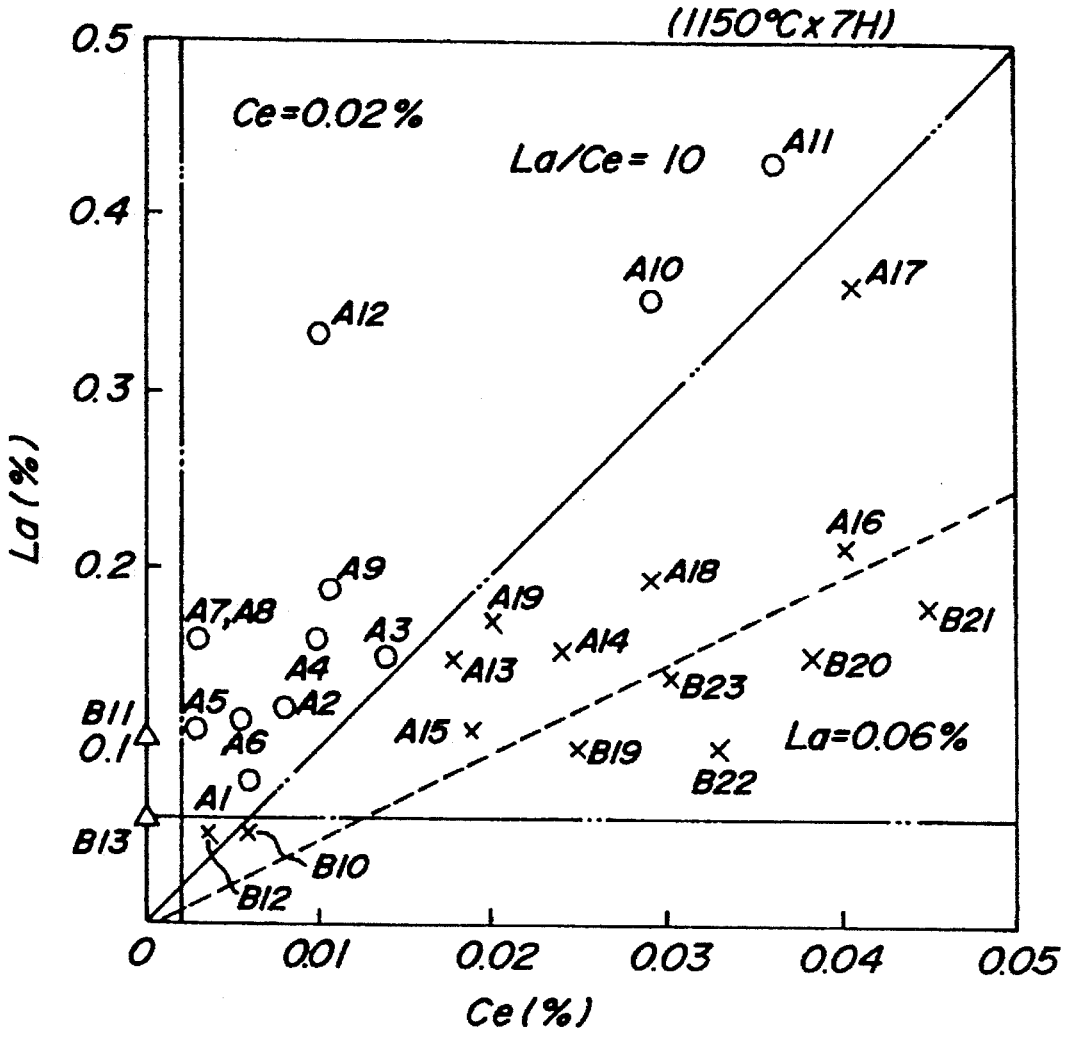
FIG. 4 is a graph showing an influence of relation between Ce and La upon oxidation resistance (1150° C.×7 Hr).

On the other hand, when La/Ce≧10 is satisfied, the oxidation resistance at higher temperature is further improved. The results of repetitive oxidation test at 1150° C. are shown in FIG. 4, from which it is confirmed that when La/Ce≧10, a total oxidation time up to abnormal oxidation is not less than 150 hours and the oxidation resistance is more improved.

(2) P≦0.020 wt %, S≦0.0050 wt %, O≦10 ppm

As mentioned in the item (1), the invention is essential to add La and Ce in an amount larger than the conventional amount, but in this case, there is a fear of degrading the hot workability. For this end, according to the invention, the degradation of the hot workability is attempted to be minimum by reducing P, S, O as a harmful element as far as possible. Particularly, it is necessary that the amount of O is maintained at a considerably low level of not more than 5 ppm.

Furthermore, these elements are apt to create joint defect in the soldering, welding or the like in addition to the degradation of hot workability, so that they are required to be reduced as far as possible.

(3) S: not more than 0.0050 wt %, [S]≦[Ca]+[Mg]+ ⅕[Ba];

S lowers the oxidation resistance and hot workability, so that it is basically restricted to not more than 0.0050 wt %. Furthermore, as seen from the relation to Ca, Mg, Ba shown in FIG. 1, when at least one of Ca, Mg, Ba is included, these elements fix S and suppresses a bad influence of Ti to the oxidation resistance (carbo-nitride of Ti is decomposed and resoluted above 1000° C., but TiS is produced on surface film/base metal boundary to cause abnormal oxidation) to promote the effect of improving the oxidation resistance through La. Therefore, Ca, Mg and Ba are required to be added in connection with S so as to satisfy the following equation:

$$[Ca]+[Mg]+\tfrac{1}{5}[Ba] \geqq [S]$$

However, when the amount of these elements is too large, the cleanness is poor and the toughness is also degraded, so that it is necessary that the amount of [Ca]+[Mg]+⅕[Ba] is within a range of 0.001–0.20 wt %.

Figure 1:
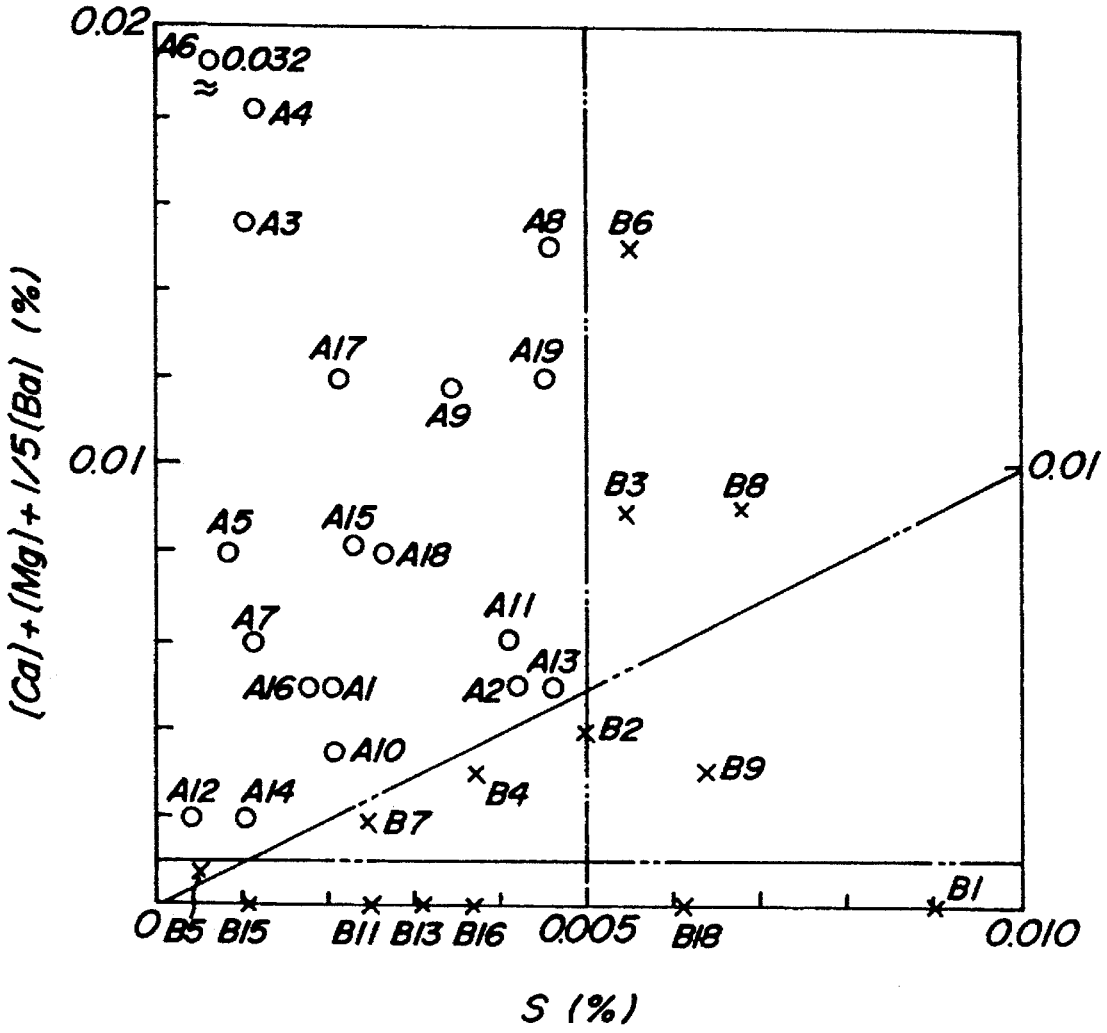
FIG. 1 is a graph showing an influence of a relation between S and [Ca, Mg, Ba] upon oxidation resistance.

Moreover, the oxidation test shown in FIG. 1 is a repetitive cycle test of heating in air at 1100° C.× 24 Hr and cooling to room temperature. The evaluation is judged whether or not the total oxidation time up to abnormal oxidation is 450 hours.

○: total oxidation time up to abnormal oxidation is more than 450 hours

Δ: total oxidation time up to abnormal oxidation is less than 450 hours and scale peeling X: total oxidation time up to abnormal oxidation is less than 450 hours (4) Ti: 0.010–0.30 wt %, Ti≧48/12[C]+48/14[N];

In the steel according to the invention, Ti is particularly a significant element from a viewpoint of the improvement of toughness. That is, Ti fixes C, N to improve the toughness. In order to obtain such an effect, it is necessary to add in an amount of at least 0.010 wt %. However, when the amount is too large, the toughness is degraded and also the oxidation resistance is lowered. For this end, the upper limit of Ti is 0.30 wt %.

Moreover, Ti bonds C, N to form TiC, TiN, so that in order to completely fix C, N in steel, a minimum addition amount of Ti is required to satisfy the following equation;

$$Ti \geqq 48/12[C]+48/14[N];$$

Furthermore, Ti serves to improve the hot workability. As the fixing action of C, N, there are known Nb, Zr, but Ti effectively acts to further improve the tissue. In this conncetion, Nb, Zr are insufficient in the effect of improving the tissue.

The reason on the limitation of the other components for obtaining the steel according to the invention having good oxidation resistance as compared with the conventional alloy will be described below. C: not more than 0.030 wt %, N: not more than 0.030 wt %;

When the amount of each of C, N exceeds 0.030 wt %, the toughness of the hot rolled steel sheet is considerably lowered. Therefore, each amount of C, N is not more than 0.030 wt %.

Si: not more than 1.0 wt %;

Si is an element for improving the oxidation resistance, but the effect thereof is not so high as compared with Al. Rather, it has a drawback of degrading the toughness. Therefore, the amount of Si is not more than 1.0 wt %.

Mn: not more than 1.0 wt %;

Mn lowers the oxidation resistance, so that the amount is restricted to not-more than 1.0 wt %.

P: not more than 0.020 wt %;

P badly affects the oxidation resistance and toughness of the hot rolled steel sheet, so that the amount is controlled to not more than 0.020 wt %.

S: not more than 0.0050 wt %;

S lowers the hot workability and oxidation resistance, so that it is controlled to not more than 0.0050 wt %.

Ni: not more than 0.5 wt %;

Ni degrades the toughness, so that it is controlled to not more than 0.5 wt %.

Cr: 15–25 wt %;

Cr is a very important element for ensuring the oxidation resistance and corrosion resistance of the stainless steel. When the amount of Cr is less than 15 wt %, these properties are insufficient, while when it exceeds 25 wt %, the toughness of the hot rolled steel sheet considerably lowers. Therefore, the Cr amount is restricted to 15–25 wt %.

Al: 3.5–15.0 wt %;

Al is an element improving the oxidation resistance. When the amount is less than 3.5 wt %, it is insufficient to ensure the oxidation resistance, while when it exceeds 15.0 wt %, the toughness is degraded. Therefore, the Al amount is 3.5–15.0 wt %.

O: not more than 10 ppm;

When O is existent in an amount exceeding 10 ppm, it bonds La, Ce to obstruct the effect of improving the oxidation resistance through La, Ce. In order to prevent the degradation of hot workability due to the addition of a great amount of La and Ce, it is necessary to control the amount as low as possible. Preferably, the amount is not more than 5 ppm.

In addition to the above components, at least one of V and W and Mo are added to the steel according to the invention, if necessary. The reason on the addition and amount of these elements is described below.

V: 0.05–2.0 wt %, W: 0.05–2.0 wt %;

V, W fix C in steel to improve the toughness of the hot rolled steel sheet. When the amount of each of V, W is less than 0.05 wt %, the above action is insufficient. However, when the amount exceeds 2.0 wt %, the toughness of the hot rolled steel sheet is degraded due to the coarsening of inclusion.

Mo: 0.01–1.0 wt %;

Mo has an action of improving the adhesion property of the surface film to control the peeling of the surface film. When the amount is less than 0.01 wt %, the above action is insufficient. When the amount exceeds 1.0 wt %, the adhesion property of the surface film is inversely degraded.

The stainless steels according to the invention can be manufactured by clad rolling Al, for example, in order to prevent brittleness due to the addition of Al and then subjecting to a diffusion heat treatment in addition to the usual melting process.

EXAMPLE 1

In a high-frequency induction heating furnace was obtained 10 kg of a steel ingot having a composition as shown in Table 1 (Alloy Examples according to the invention: A1–A22) and Table 2 (Comparative Examples: B1–B23, provided that Conventional example 1: B10, B12, Conventional Example 2: B11, B13, Conventional Example 3: B15, B16, B18). The steel ingot was forged into a plate of 40 mm in thickness and 50 mm in width, which was further hot rolled to obtain a hot rolled sheet of 2.5 mm in thickness. The tests for oxidation resistance and toughness were made with respect to each of the resulting hot rolled sheets. The results are shown in Table 3 and Table 4.

④ As to the test for the oxidation resistance, foils of 50 μm in thickness were produced from the above hot rolled sheet by repeating cold rolling and annealing (900° C.×2 minutes), from which two foils of 25 mm×50 mm were taken and one of the foils was shaped into a flat form and the other foil was subjected to corrugating work and joined to each other by vacuum heat treatment of 1200° C.×20 minutes with Ni-based solder. The foil was heated at 1100° C. in air for 24 hours and cooled to room temperature to measure a weight change, which was 1 cycle. This cycle was repeated, whereby the oxidation resistance was evaluated by a total oxidation time till abnormal oxidation and scale peeling occurred. Moreover, the abnormal oxidation means that the oxidation curve largely shifts from a parabola rule or a straight line rule to increase the oxidation increment, while the scale peeling means that the oxidation film is peeled off to rapidly reduce the weight of the test piece.

② As to the toughness, the hot rolled sheet was subjected to a solution heat treatment at 950° C.—10 minutes and then cooled with water, which was subjected to a Charpy impact test to evaluate a ductility— brittleness transformation temperature.

③ As to the hot workability, a test piece was taken out from 10 kg of the steel ingot in a direction perpendicular to columnar structure and was held at 1200° C.×90 seconds, and the temperature was lowered to 900° C., which was subjected to a tensile test to evaluate as a reduction of area. Moreover, if the reduction of area at 900° C. is not less than 80%, the rolling is possible without causing crack in hot rolling.

As seen from the results of Tables 3 and 4, the acceptable examples according to the invention show good properties that the total oxidation time till the occurrence of abnormal oxidation is not less than 450 hours, and the ductility-brittleness transformation temperature is not more than 80° C. and the reduction of area at 900° C. is not less than 85%. On the contrary, in B10 and B12 corresponding to the conventional alloy 1 (JP-B-2-58340), the time till the occurrence of abnormal oxidation is very short because the amount of La, Ce is small. Further, B11, B13 corresponding to the conventional alloy 2 (JP-B-4-8502) do not contain Ce, so that the scale peeling is caused and the oxidation in the soldered portion becomes conspicuous. Moreover, in B15, B16, B18 corresponding to the conventional alloy 3 (JP-A-3-170642), Ce bond P to lose the action as an element of improving the oxidation resistance and hence the time till the occurrence of abnormal oxidation becomes short.

FIG. 2 shows a relation between time and oxidation increment in the alloy A3 according to the invention and the comparative alloy C22. As seen from this figure, in the alloy A3 according to the invention, not only the time till the occurrence of abnormal oxidation becomes long, but also the curve is shifted toward a low side.

FIG. 3 shows an influence of a relation between La and Ce upon the total oxidation time till the occurrence of abnormal oxidation among typical composition examples in the alloys according to the invention (A1–A22) and the comparative alloys (B1– B23). Moreover, the evaluation of ○Δ X is standardized whether or not the total oxidation time till the occurrence of abnormal oxidation is not less than 450 hours in the repetitive test of cycle of heating in air at 1100° C.×24 Hr and cooling to room temperature as mentioned below.

○: total oxidation time up to abnormal oxidation is more than 450 hours

Δ: total oxidation time up to abnormal oxidation is less than 450 hours and scale peeling X: total oxidation time up to abnormal oxidation is less than 450 hours

EXAMPLE 2

In order to examine the relation of La/Ce in more detail, the repetitive oxidation test shown in Example 1 is carried out under severer conditions (1 cycle of heating in air at 1150° C. for 7 hours and cooling to room temperature). The other test conditions are the same as in Example 1.

As seen from the results of Table 3 and Table 4, the alloys of La/Ce≧10 (A1–A12) among those according to the invention show good property that the time till the occurrence of abnormal oxidation is not less than 150 hours (see FIG. 4).

However, it has been confirmed that in the alloys of La/Ce= 5–10 (A13–A22), the time till the occurrence of abnormal oxidation is less than 150 hours as compared with those of La/Ce≧10 and have a problem in use under severe conditions.

On the other hand, the amount of La, Ce is small in B10, B12 corresponding to the conventional alloy 1, so that the time till the occurrence of abnormal oxidation is very short. Further, B11, B13 corresponding to the conventional alloy 2 do not contain Ce, so that the scale peeling is caused and the oxidation in the soldered portion is conspicuous. In B15, B16, B18 corresponding to the conventional alloy 3, Ce bonds P to lose the action as an element of improving the oxidation resistance and hence the time till the occurrence of abnormal oxidation becomes short.

Therefore, it has been confirmed that more excellent oxidation resistance can be obtained by La/Ce≧ 10 as a preferable range of La/Ce.

Moreover, FIG. 4 shows results of repetitive test of cycle of heating in air at 1150° C.×7 Hr and cooling to room temperature.

○: total oxidation time up to abnormal oxidation is more than 150 hours

Δ: total oxidation time up to abnormal oxidation is less than 150 hours and scale peeling X: total oxidation time up to abnormal oxidation is less than 150 hours As mentioned above, the invention provides ferritic stainless steels simultaneously realizing more excellent oxidation resistance and excellent toughness and hot workability by precisely controlling La/Ce ratio, relation of [S] and [Ca, Mg, Ba] and relation of Ti and [C, N].

TABLE 1

| | C | Si | Mn | P | S | Ni | Cr | Al | Ti | N | Ca | Mg | Ba | La | Ce |
|---|---|---|---|---|---|---|---|---|---|---|---|---|---|---|---|
| | | | | | | Alloys according to the invention | | | | | | | | | |
| A1 | 0.002 | 0.41 | 0.30 | 0.014 | 0.0020 | 0.21 | 20.21 | 5.05 | 0.030 | 0.004 | 0.005 | — | — | 0.082 | 0.006 |
| A2 | 0.003 | 0.35 | 0.22 | 0.019 | 0.0042 | 0.15 | 20.11 | 4.85 | 0.080 | 0.005 | — | 0.005 | — | 0.122 | 0.008 |
| A3 | 0.005 | 0.22 | 0.25 | 0.018 | 0.0010 | 0.20 | 19.87 | 5.11 | 0.110 | 0.008 | 0.002 | 0.006 | 0.038 | 0.151 | 0.014 |
| A4 | 0.011 | 0.30 | 0.28 | 0.020 | 0.0011 | 0.16 | 17.54 | 6.05 | 0.050 | 0.005 | 0.011 | — | 0.041 | 0.161 | 0.010 |
| A5 | 0.010 | 0.23 | 0.20 | 0.016 | 0.0008 | 0.25 | 19.52 | 5.44 | 0.066 | 0.004 | — | 0.008 | — | 0.109 | 0.003 |
| A6 | 0.004 | 0.31 | 0.22 | 0.017 | 0.0006 | 0.32 | 16.05 | 6.52 | 0.041 | 0.002 | — | — | 0.162 | 0.115 | 0.006 |
| A7 | 0.003 | 0.54 | 0.21 | 0.019 | 0.0011 | 0.21 | 19.93 | 5.42 | 0.031 | 0.003 | — | 0.006 | — | 0.162 | 0.003 |
| A8 | 0.004 | 0.37 | 0.26 | 0.020 | 0.0046 | 0.19 | 20.43 | 5.18 | 0.055 | 0.005 | 0.009 | 0.006 | — | 0.162 | 0.003 |
| A9 | 0.005 | 0.24 | 0.22 | 0.019 | 0.0034 | 0.17 | 20.06 | 4.97 | 0.063 | 0.006 | 0.004 | 0.005 | 0.014 | 0.188 | 0.011 |
| A10 | 0.004 | 0.37 | 0.26 | 0.019 | 0.0046 | 0.19 | 20.43 | 5.18 | 0.055 | 0.005 | 0.009 | 0.006 | — | 0.351 | 0.029 |
| A11 | 0.005 | 0.24 | 0.22 | 0.020 | 0.0034 | 0.17 | 20.06 | 4.97 | 0.063 | 0.006 | 0.004 | 0.005 | 0.014 | 0.428 | 0.036 |
| A12 | 0.005 | 0.24 | 0.22 | 0.016 | 0.0034 | 0.17 | 20.06 | 4.97 | 0.063 | 0.006 | 0.004 | 0.005 | 0.014 | 0.335 | 0.010 |
| A13 | 0.004 | 0.37 | 0.26 | 0.020 | 0.0046 | 0.19 | 20.43 | 5.18 | 0.055 | 0.005 | 0.009 | 0.006 | — | 0.162 | 0.018 |

TABLE 1-continued

| | | | | | | | | | | | | | | | |
|---|---|---|---|---|---|---|---|---|---|---|---|---|---|---|---|
| A14 | 0.005 | 0.24 | 0.22 | 0.020 | 0.0034 | 0.17 | 20.06 | 4.97 | 0.063 | 0.006 | 0.004 | 0.005 | 0.014 | 0.188 | 0.024 |
| A15 | 0.004 | 0.37 | 0.26 | 0.019 | 0.0046 | 0.19 | 20.43 | 5.18 | 0.055 | 0.005 | 0.009 | 0.006 | — | 0.162 | 0.019 |
| A16 | 0.005 | 0.24 | 0.22 | 0.018 | 0.0034 | 0.17 | 20.06 | 4.97 | 0.063 | 0.006 | 0.004 | 0.005 | 0.014 | 0.188 | 0.040 |
| A17 | 0.004 | 0.37 | 0.26 | 0.019 | 0.0046 | 0.19 | 20.43 | 5.18 | 0.055 | 0.005 | 0.009 | 0.006 | — | 0.162 | 0.040 |
| A18 | 0.005 | 0.24 | 0.22 | 0.017 | 0.0034 | 0.17 | 20.06 | 4.97 | 0.063 | 0.006 | 0.004 | 0.005 | 0.014 | 0.188 | 0.029 |
| A19 | 0.005 | 0.24 | 0.22 | 0.016 | 0.0034 | 0.17 | 20.06 | 4.97 | 0.063 | 0.006 | 0.004 | 0.005 | 0.014 | 0.188 | 0.020 |
| A20 | 0.003 | 0.39 | 0.30 | 0.018 | 0.0028 | 0.20 | 18.80 | 7.20 | 0.051 | 0.003 | — | 0.010 | — | 0.162 | 0.030 |
| A21 | 0.003 | 0.38 | 0.30 | 0.018 | 0.0028 | 0.20 | 18.71 | 8.50 | 0.050 | 0.003 | — | 0.010 | — | 0.162 | 0.030 |
| A22 | 0.003 | 0.38 | 0.30 | 0.018 | 0.0028 | 0.20 | 18.59 | 13.20 | 0.050 | 0.003 | — | 0.010 | — | 0.162 | 0.030 |

| | 0 (ppm) | (wt %) others | Ca + Mg + 1/5Ba | La/Ce | La + Ce |
|---|---|---|---|---|---|
| | | Alloys according to the invention | | | |
| A1 | 4 | — | 0.005 | 13.7 | 0.088 |
| A2 | 8 | — | 0.005 | 15.3 | 0.130 |
| A3 | 3 | — | 0.0156 | 10.8 | 0.165 |
| A4 | 3 | V: 0.15 | 0.0192 | 16.1 | 0.112 |
| A5 | 4 | — | 0.008 | 36.3 | 0.171 |
| A6 | 2 | W: 0.51 | 0.0324 | 19.2 | 0.121 |
| A7 | 4 | V: 0.10<br>Mo: 0.51<br>W: 0.22 | 0.006 | 54.0 | 0.165 |
| A8 | 6 | Mo: 0.51 | 0.015 | 54.0 | 0.165 |
| A9 | 5 | — | 0.0118 | 17.1 | 0.199 |
| A10 | 4 | — | 0.035 | 12.1 | 0.380 |
| A11 | 5 | Mo: 0.25 | 0.006 | 11.9 | 0.464 |
| A12 | 3 | W: 1.40 | 0.002 | 33.5 | 0.345 |
| A13 | 6 | — | 0.005 | 8.4 | 0.170 |
| A14 | 3 | — | 0.002 | 6.4 | 0.180 |
| A15 | 5 | — | 0.0082 | 5.9 | 0.131 |
| A16 | 4 | Mo: 0.72 | 0.005 | 5.4 | 0.255 |
| A17 | 3 | V: 0.15 | 0.012 | 9.0 | 0.217 |
| A18 | 3 | V: 1.25<br>Mo: 0.30 | 0.008 | 6.7 | 0.202 |
| A19 | 2 | — | 0.011 | 8.5 | 0.190 |
| A20 | 4 | — | 0.010 | 5.4 | 0.192 |
| A21 | 4 | — | 0.010 | 5.4 | 0.192 |
| A22 | 4 | — | 0.010 | 5.4 | 0.192 |

TABLE 2

| | C | Si | Mn | P | S | Ni | Cr | Al | Ti | N | Ca | Mg | Ba | La | Ce |
|---|---|---|---|---|---|---|---|---|---|---|---|---|---|---|---|
| | | | | | | Convention Examples | | | | | | | | | |
| B1 | 0.003 | 0.33 | 0.22 | 0.020 | 0.0090 | 0.30 | 20.02 | 4.99 | 0.122 | 0.006 | — | — | — | 0.142 | 0.010 |
| B2 | 0.005 | 0.42 | 0.33 | 0.018 | 0.0050 | 0.33 | 19.32 | 5.05 | 0.052 | 0.008 | 0.004 | — | — | 0.088 | 0.004 |
| B3 | 0.006 | 0.41 | 0.31 | 0.020 | 0.0055 | 0.22 | 18.51 | 4.82 | 0.133 | 0.009 | 0.004 | 0.005 | — | 0.150 | 0.006 |
| B4 | 0.018 | 0.32 | 0.30 | 0.020 | 0.0037 | 0.33 | 19.22 | 5.05 | — | 0.012 | — | 0.003 | — | 0.121 | 0.005 |
| B5 | 0.004 | 0.28 | 0.28 | 0.019 | 0.0005 | 0.28 | 19.89 | 5.25 | 0.059 | 0.005 | — | — | 0.004 | 0.092 | 0.002 |
| B6 | 0.006 | 0.24 | 0.24 | 0.020 | 0.0055 | 0.25 | 20.03 | 4.98 | 0.041 | 0.003 | 0.008 | 0.006 | 0.005 | 0.153 | 0.007 |
| B7 | 0.002 | 0.27 | 0.26 | 0.020 | 0.0025 | 0.27 | 19.98 | 5.01 | 0.087 | 0.004 | — | 0.002 | — | 0.175 | 0.004 |
| B8 | 0.005 | 0.31 | 0.27 | 0.019 | 0.0068 | 0.31 | 19.86 | 5.15 | 0.073 | 0.003 | 0.006 | 0.003 | — | 0.077 | 0.003 |
| B9 | 0.003 | 0.29 | 0.25 | 0.018 | 0.0064 | 0.29 | 22.15 | 4.99 | 0.065 | 0.007 | 0.002 | — | 0.005 | 0.121 | 0.005 |
| B10 | 0.004 | 0.32 | 0.29 | 0.020 | 0.0031 | 0.31 | 19.85 | 4.92 | — | 0.006 | — | 0.003 | — | 0.050 | 0.006 |
| B11 | 0.008 | 0.27 | 0.27 | 0.020 | 0.0025 | 0.28 | 20.08 | 5.16 | 0.044 | 0.005 | — | — | — | 0.110 | — |
| B12 | 0.005 | 0.31 | 0.23 | 0.019 | 0.0015 | 0.22 | 20.00 | 5.02 | — | 0.005 | 0.002 | 0.002 | — | 0.050 | 0.004 |
| B13 | 0.002 | 0.43 | 0.31 | 0.018 | 0.0031 | 0.23 | 09.92 | 5.08 | 0.063 | 0.006 | — | — | — | 0.063 | — |
| B14 | 0.005 | 0.22 | 0.24 | 0.020 | 0.0020 | 0.13 | 20.03 | 5.00 | 0.142 | 0.007 | — | 0.010 | 0.007 | 0.041 | 0.021 |
| B15 | 0.004 | 0.37 | 0.21 | 0.028 | 0.0011 | 0.22 | 19.86 | 4.88 | 0.054 | 0.006 | — | — | — | 0.067 | 0.009 |
| B16 | 0.003 | 0.29 | 0.20 | 0.026 | 0.0037 | 0.14 | 19.97 | 5.02 | 0.031 | 0.003 | — | — | — | 0.115 | 0.013 |
| B17 | 0.002 | 0.41 | 0.30 | 0.018 | 0.0020 | 0.21 | 20.16 | 5.18 | 0.040 | 0.004 | 0.006 | — | — | 0.121 | 0.007 |
| B18 | 0.004 | 0.39 | 0.26 | 0.024 | 0.0061 | 0.25 | 20.11 | 4.90 | 0.025 | 0.005 | — | — | — | 0.115 | 0.010 |
| B19 | 0.002 | 0.29 | 0.25 | 0.020 | 0.0040 | 0.29 | 20.51 | 4.79 | 0.071 | 0.004 | 0.005 | — | — | 0.102 | 0.025 |
| B20 | 0.003 | 0.31 | 0.28 | 0.019 | 0.0050 | 0.21 | 20.62 | 5.01 | 0.059 | 0.007 | — | 0.007 | — | 0.495 | 0.038 |
| B21 | 0.005 | 0.32 | 0.31 | 0.018 | 0.0047 | 0.30 | 20.11 | 5.21 | 0.079 | 0.005 | — | 0.008 | — | 0.182 | 0.045 |
| B22 | 0.004 | 0.30 | 0.29 | 0.019 | 0.0031 | 0.33 | 20.35 | 5.15 | 0.101 | 0.006 | 0.004 | — | 0.002 | 0.101 | 0.033 |
| B23 | 0.003 | 0.29 | 0.30 | 0.020 | 0.0029 | 0.35 | 19.78 | 5.08 | 0.121 | 0.007 | 0.005 | — | — | 0.135 | 0.030 |

| | 0 (ppm) | (wt %) others | Ca + Mg + 1/5Ba | La/Ce | La + Ce |
|---|---|---|---|---|---|
| | | Convention Examples | | | |
| B1 | 4 | — | — | 14.2 | 0.152 |

TABLE 2-continued

| | | | | | |
|---|---|---|---|---|---|
| B2 | 6 | — | 0.004 | 22.0 | 0.092 |
| B3 | 8 | — | 0.009 | 25.0 | 0.156 |
| B4 | 3 | — | 0.003 | 24.2 | 0.126 |
| B5 | 5 | — | 0.0008 | 46.0 | 0.094 |
| B6 | 6 | — | 0.015 | 21.9 | 0.160 |
| B7 | 7 | — | 0.002 | 43.8 | 0.179 |
| B8 | 9 | — | 0.009 | 25.7 | 0.080 |
| B9 | 10 | — | 0.003 | 8.3 | 0.126 |
| B10 | 7 | — | 0.003 | 12.1 | 0.056 |
| B11 | 4 | — | — | — | 0.114 |
| B12 | 3 | — | 0.004 | 12.5 | 0.054 |
| B13 | 5 | — | — | — | 0.063 |
| B14 | 6 | — | 0.0114 | 2.0 | 0.062 |
| B15 | 5 | — | — | 7.4 | 0.076 |
| B16 | 4 | — | — | 8.8 | 0.128 |
| B17 | 18 | — | 0.006 | 17.3 | 0.128 |
| B18 | 21 | — | — | 11.5 | 0.125 |
| B19 | 4 | — | 0.005 | 4.1 | 0.127 |
| B20 | 7 | — | 0.007 | 3.9 | 0.187 |
| B21 | 3 | — | 0.008 | 4.0 | 0.227 |
| B22 | 6 | — | 0.0044 | 3.1 | 0.134 |
| B23 | 3 | — | 0.005 | 4.5 | 0.165 |

TABLE 3

| | Test results | | | | Evaluations | | | |
|---|---|---|---|---|---|---|---|---|
| | Total oxidation time till the occurrence of abnormal oxidation at 1100° C. (Hr) | Total oxidation time till the occurrence of abnormal oxidation at 1150° C. (Hr) | Ductility-brightness transformation temperature (°C.) | Reduction af area at 900° C. (%) | Oxidation resistance at 1100° C. | Oxidation resistance at 1150° C. | Toughness | Hot work-ability |
| A1 | 528 | 161 | 40 | 85 | o | o | o | o |
| A2 | 552 | 154 | 40 | 90 | o | o | o | o |
| A3 | 552 | 167 | 60 | 88 | o | o | o | o |
| A4 | 576 | 181 | 80 | 91 | o | o | o | o |
| A5 | 552 | 167 | 60 | 89 | o | o | o | o |
| A6 | 576 | 174 | 80 | 90 | o | o | o | o |
| A7 | 600 | 174 | 50 | 87 | o | o | o | o |
| A8 | 600 | 189 | 40 | 86 | o | o | o | o |
| A9 | 624 | 198 | 50 | 93 | o | o | o | o |
| A10 | 600 | 167 | 40 | 92 | o | o | o | o |
| A11 | 600 | 167 | 60 | 90 | o | o | o | o |
| A12 | 576 | 189 | 60 | 90 | o | o | o | o |
| A13 | 470 | 112 | 40 | 90 | o | x | o | o |
| A14 | 470 | 119 | 60 | 88 | o | x | o | o |
| A15 | 446 | 119 | 40 | 86 | o | x | o | o |
| A16 | 494 | 126 | 60 | 90 | o | x | o | o |
| A17 | 494 | 126 | 60 | 91 | o | x | o | o |
| A18 | 494 | 112 | 50 | 90 | o | x | o | o |
| A19 | 470 | 119 | 40 | 89 | o | x | o | o |
| A20 | ≧1000 | 630 | 60 | 92 | o | o | o | o |
| A21 | ≧1000 | ≧1000 | 80 | 90 | o | o | o | o |
| A22 | ≧1000 | ≧1000 | 80 | 90 | o | o | o | o |

① Oxidation test conditions: Repetitive oxidation test of 1 cycle of heating in air at 1100° C. × 24 Hr and cooling to room temperature
o: total oxidation time up to abnormal oxidation is more than 450 hours
Δ: total oxidation time up to abnormal oxidation is less than 450 hours and scale peeling
x: total oxidation time up to abnormal oxidation is less than 450 hours
② Oxidation test conditions: Repetitive oxidation test of 1 cycle of heating in air at 1150° C. × 7 Hr and cooling to room temperature
o: total oxidation time up to abnormal oxidation is more than 150 hours
Δ: total oxidation time up to abnormal oxidation is less than 150 hours and scale peeling
x: total oxidation time up to abnormal oxidation is less than 150 hours
Toughness sheet of 2.5 mmt V-notch Charpy
Ductility-brittleness temperature o: DBTT ≦ 80° C. x: DBTT > 80° C.
Reduction of area at 900° C. o: not less than 85% x: less than 85%

TABLE 4

| | Test results | | | | Evaluation | | | | |
|---|---|---|---|---|---|---|---|---|---|
| | Total oxidation time till the occurrence of abnormal oxidation at 1100° C. (Hr) | Total oxidation time till the occurrence of abnormal oxidation at 1150° C. (Hr) | Ductility-brittleness transformation temperature (°C.) | Reduction of area at 900° C. (%) | Oxidation resistance at 1100° C. | Oxidation resistance at 1150° C. | Tough-ness | Hot work-ability | Re-marks |
| B1 | 360 | 105 | 50 | 58 | x | x | o | x | |
| B2 | 432 | 98 | 50 | 69 | x | x | o | x | |
| B3 | 408 | 112 | 60 | 62 | x | x | o | x | |
| B4 | 408 | 131 | 130 | 70 | x | x | x | x | |
| B5 | 408 | 91 | 50 | 69 | x | x | o | x | |
| B6 | 384 | 112 | 40 | 64 | x | x | o | x | |
| B7 | 408 | 112 | 40 | 62 | x | x | o | x | |
| B8 | 360 | 84 | 40 | 58 | x | x | o | x | |
| B9 | 360 | 105 | 40 | 60 | x | x | o | x | |
| B10 | 288 | 63 | 110 | 87 | x | x | x | o | * |
| B11 | 336 | 105 | 50 | 85 | Δ | Δ | o | o | ** |
| B12 | 264 | 84 | 110 | 91 | x | x | x | o | * |
| B13 | 360 | 77 | 40 | 88 | Δ | Δ | o | o | ** |
| B14 | 312 | 70 | 70 | 89 | x | x | o | o | |
| B15 | 384 | 63 | 50 | 75 | x | x | o | x | *** |
| B16 | 360 | 105 | 40 | 83 | x | x | o | o | *** |
| B17 | 336 | 112 | 40 | 69 | x | x | o | x | |
| B18 | 384 | 105 | 100 | 60 | x | x | x | x | *** |
| B19 | 360 | 84 | 40 | 92 | x | x | o | o | |
| B20 | 360 | 91 | 60 | 87 | x | x | o | o | |
| B21 | 384 | 77 | 40 | 88 | x | x | o | o | |
| B22 | 360 | 84 | 40 | 93 | x | x | o | o | |
| B23 | 360 | 91 | 50 | 89 | x | x | o | o | |

① Oxidation test conditions: Repetitive oxidation test of 1 cycle of heating in air at 1100° C. × 24 Hr and cooling to room temperature
o: total oxidation time up to abnormal oxidation is more than 450 hours
Δ: total oxidation time up to abnormal oxidation is less than 450 hours and scale peeling
x: total oxidation time up to abnormal oxidation is less than 450 hours
② Oxidation test conditions: Repetitive oxidation test of 1 cycle of heating in air at 1150° C. × 7 Hr and cooling to room temperature
o: total oxidation time up to abnormal oxidation is more than 150 hours
Δ: total oxidation time up to abnormal oxidation is less than 150 hours and scale peeling
x: total oxidation time up to abnormal oxidation is less than 150 hours
*JP-B-2-58340
**JP-B-4-8502
***JP-A-3-170642

INDUSTRIAL APPLICABILITY

The ferritic stainless steels according to the invention are useful,as a material for a combustion tube of a stove, a material for an exhaust gas purifying device in an automobile and a material for an electrical heating body.

We claim:

1. A ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06–0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and the reminder being Fe and inevitable impurities.

2. A ferritic stainless steel having an excellent oxidation resistance, comprising C: not more than 0.030 wt %, Si: not more than 1.0 wt %., Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06–0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing at least one of V: 0.05–2.0 wt % and W: 0.05–2.0 wt %, and the reminder being Fe and inevitable impurities.

3. A ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06–0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing Mo: 0.01–1.0 wt %, and the reminder being Fe and inevitable impurities.

4. A ferritic stainless steel having an excellent oxidation resistance, comprising C: not more than 0.030 wt %, Si: not more than 1.0 wt %, Mn: not more than 1.0 wt %, Ni: not more than 0.5 wt %, Cr: 15–25 wt %, Al: 3.5–15.0 wt %, Ti: 0.010–0.30 wt %, N: not more than 0.030 wt %, P: not more than 0.020 wt %, S: not more than 0.0050 wt %, O: not more than 10 ppm, and containing 0.001–0.20 wt % of one or more of Ca, Mg and Ba as [Ca]+[Mg]+⅕[Ba], La: 0.06–0.5 wt % and Ce: 0.002–0.050 wt %, provided that these elements satisfy relations of the following equations (1)–(3):

$$[S] \leqq [Ca]+[Mg]+\tfrac{1}{5}[Ba] \quad (1)$$

$$[La]/[Ce] \geqq 5 \quad (2)$$

$$Ti \geqq 48/12[C]+48/14[N] \quad (3)$$

and further containing at least one of V: 0.05–2.0 wt % and W: 0.05–2.0 wt % and Mo: 0.01–1.0 wt %, and the reminder being Fe and inevitable impurities.

* * * * *

UNITED STATES PATENT AND TRADEMARK OFFICE

CERTIFICATE OF CORRECTION

PATENT NO. : 5,480,608

DATED : January 2, 1996

INVENTOR(S) : M. TSUDA et al.

It is certified that error appears in the above-indentified patent and that said Letters Patent is hereby corrected as shown below:

At column 13, line 67 (claim 1, line 14), change "reminder" to ---remainder---.

At column 14, line 56 (claim 2, line 15), change "reminder" to ---remainder---.

At column 15, line 6 (claim 3, line 14), change "reminder" to ---remainder---.

At column 16, line 11 (claim 4, line 15), change "reminder" to ---remainder---.

Signed and Sealed this

Twelfth Day of November, 1996

*Attest:*

Bruce Lehman

BRUCE LEHMAN

*Attesting Officer*

*Commissioner of Patents and Trademarks*